United States Patent [19]

Learmont

[11] 4,174,579

[45] Nov. 20, 1979

[54] TWIN BOOM DRAGLINE

[75] Inventor: Tom Learmont, Wauwatosa, Wis.

[73] Assignee: Bucyrus-Erie Company, South Milwaukee, Wis.

[21] Appl. No.: 883,230

[22] Filed: Mar. 3, 1978

[51] Int. Cl.[2] ..... E02F 3/48

[52] U.S. Cl. ..... 37/116; 212/47

[58] Field of Search ..... 37/115, 116, 117, 135, 37/136; 212/47, 58 A, 44, 3

[56] References Cited

U.S. PATENT DOCUMENTS

| | | | |
|---|---|---|---|
| 517,559 | 4/1894 | Arch | 37/116 X |
| 534,973 | 2/1895 | Smith | 37/116 X |
| 825,200 | 7/1906 | Dunlop | 37/116 X |
| 1,002,732 | 9/1911 | Morris | 37/116 X |
| 1,015,240 | 1/1912 | Miller | 212/44 X |
| 1,219,371 | 3/1971 | Butterfield | 37/116 X |
| 1,331,883 | 2/1920 | Stuart | 214/10 |
| 1,335,455 | 3/1920 | Stuart | 214/10 |
| 1,464,454 | 8/1923 | Thompson | 37/116 |
| 1,636,136 | 7/1927 | Kernes | 37/116 |
| 1,705,274 | 3/1929 | Von Thaden | 214/10 |
| 2,530,150 | 11/1950 | Bryant | 37/116 |
| 2,602,245 | 7/1952 | Nickles | 37/116 |
| 2,609,621 | 9/1952 | Babin | 37/116 |
| 3,386,593 | 6/1968 | Sprengel | 212/3 |
| 3,446,363 | 5/1969 | Sprengel | 212/3 |
| 3,901,341 | 8/1975 | Stoldt | 180/8 D |
| 3,959,899 | 6/1976 | Rangaswamy | 37/116 |

FOREIGN PATENT DOCUMENTS

| | | | |
|---|---|---|---|
| 1246200 | 8/1967 | Fed. Rep. of Germany | 212/58 A |
| 1013038 | 4/1952 | France | 37/116 |

*Primary Examiner*—Clifford D. Crowder
*Attorney, Agent, or Firm*—Quarles & Brady

[57] ABSTRACT

A dragline has two booms at a ninety degree angle with the dragrope between them. Each boom has a variable speed hoist mechanism and both hoist ropes are connected to the bucket. Either boom can be used as a digging boom, with the other serving as a dumping boom, and relative hoist speeds are controlled to move a filled bucket to a dumping position under the dumping boom and back to start position under the digging boom.

4 Claims, 6 Drawing Figures

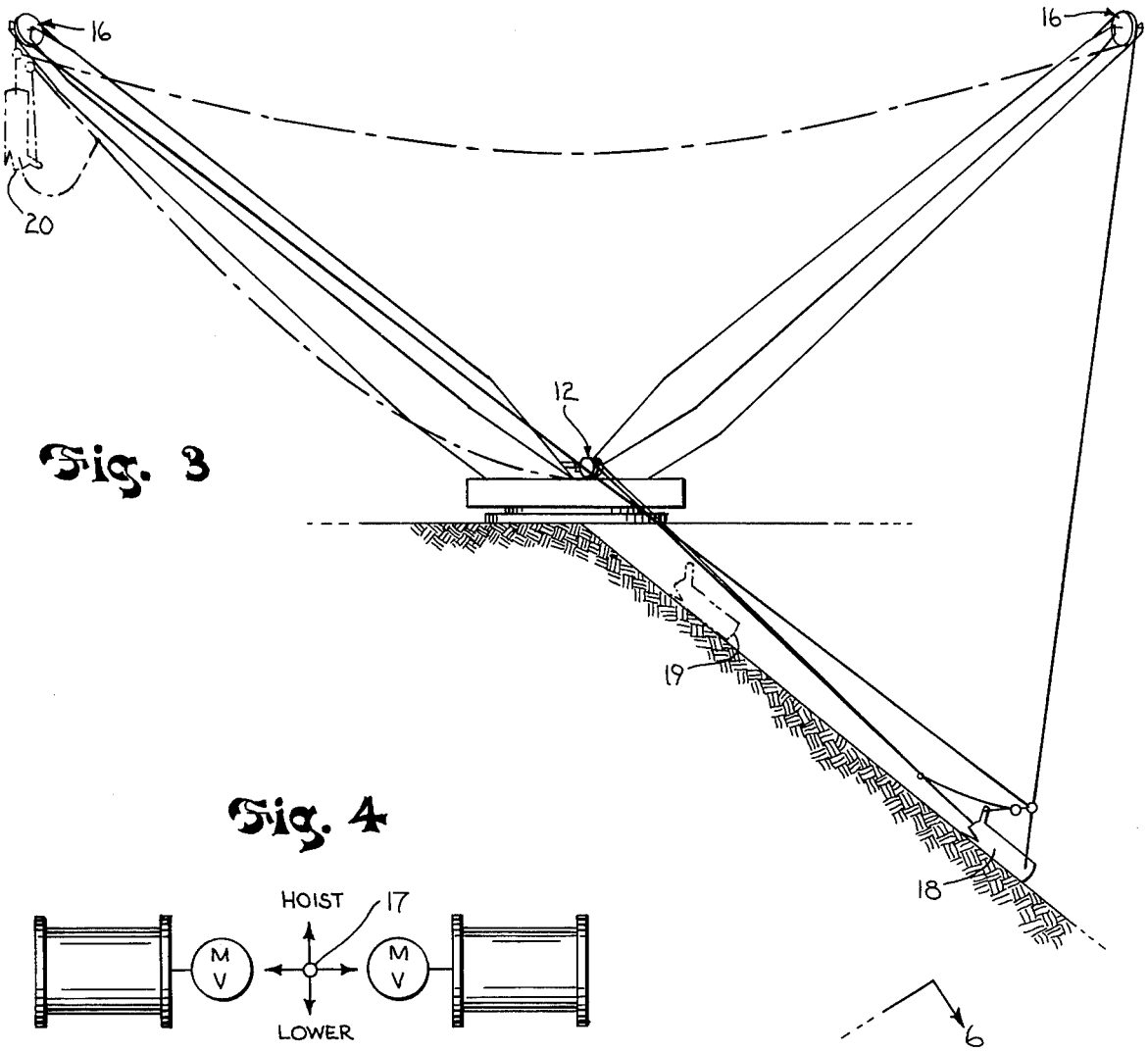
Fig. 3
Fig. 4
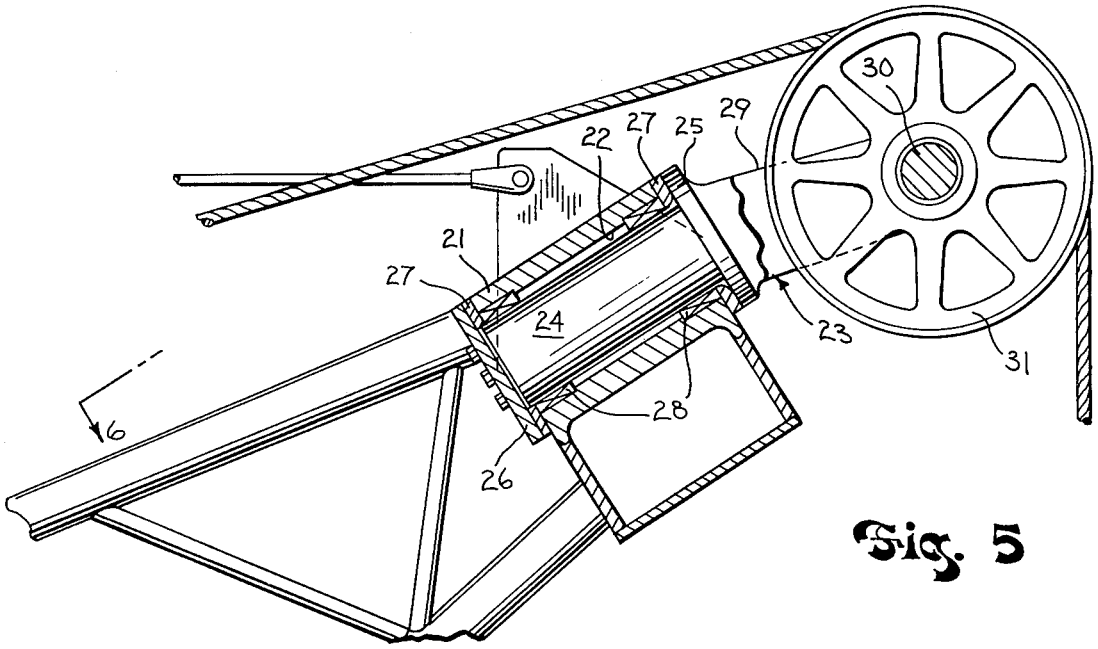
Fig. 5

TWIN BOOM DRAGLINE

BACKGROUND OF THE INVENTION

The dragline has become the dominant tool for stripping overburden because of its flexibility and other advantages, but constant efforts are being made to continue to improve dragline productivity. One critical productivity factor is the time required for each digging cycle. With conventional single boom machines, the cycle includes spotting the bucket in a start position under the boom, dragging it toward the machine to a filled position, hoisting the bucket, swinging the boom to a dump position (usually at about a ninety degree angle to the line of digging), dumping, returning the boom to digging position, and again spotting the bucket. Raising and lowering of the bucket by the hoisting mechanism are at least largely accomplished during swinging of the boom between digging and dump positions, but the time required for raising and lowering is substantially less than that required for swinging, so that swing time is an extremely important factor. Swing speed can be increased to some extent by reduction of inertia loads, increase of swing power, etc., but such efforts generally yield only a modest increase in speed which may be more than offset by increased costs, possible effects on machinery reliability and the like.

SUMMARY OF THE INVENTION

This invention contemplates a dragline provided with two booms disposed at an angle to one another, one serving as a digging boom while the other serves as a dumping boom; in the preferred embodiment either boom can serve either function. There are hoist mechanisms for each boom with the two hoist lines leading to the bucket, and relative hoist speed is controlled so that as the bucket is lifted from filled position it is also moved to a dump position under the dumping boom. During lowering, the bucket moves back to its start position. Over an average range of digging operations, this can reduce overall cycle time by as much as 25 percent, thus providing a dramatic increase in productivity and unexpectedly increasing cost efficiency in spite of the cost involved in providing an additional boom and hoist mechanism. Specific features, objects and advantages of the invention will become more clear from the description to follow.

BRIEF DESCRIPTION OF THE DRAWINGS

FIG. 3 is a view similar to FIG. 2 through the plane 3—3 shown in FIG. 2;

FIG. 4 is a schematic representation of the hoist motor operating arrangement for the dragline of FIGS. 1—3;

FIG. 5 is an enlarged fragmentary side view, partially broken away, showing a boom pivot sheave assembly for the dragline of FIG. 1.

DESCRIPTION OF THE PREFERRED EMBODIMENT

Figure 1:
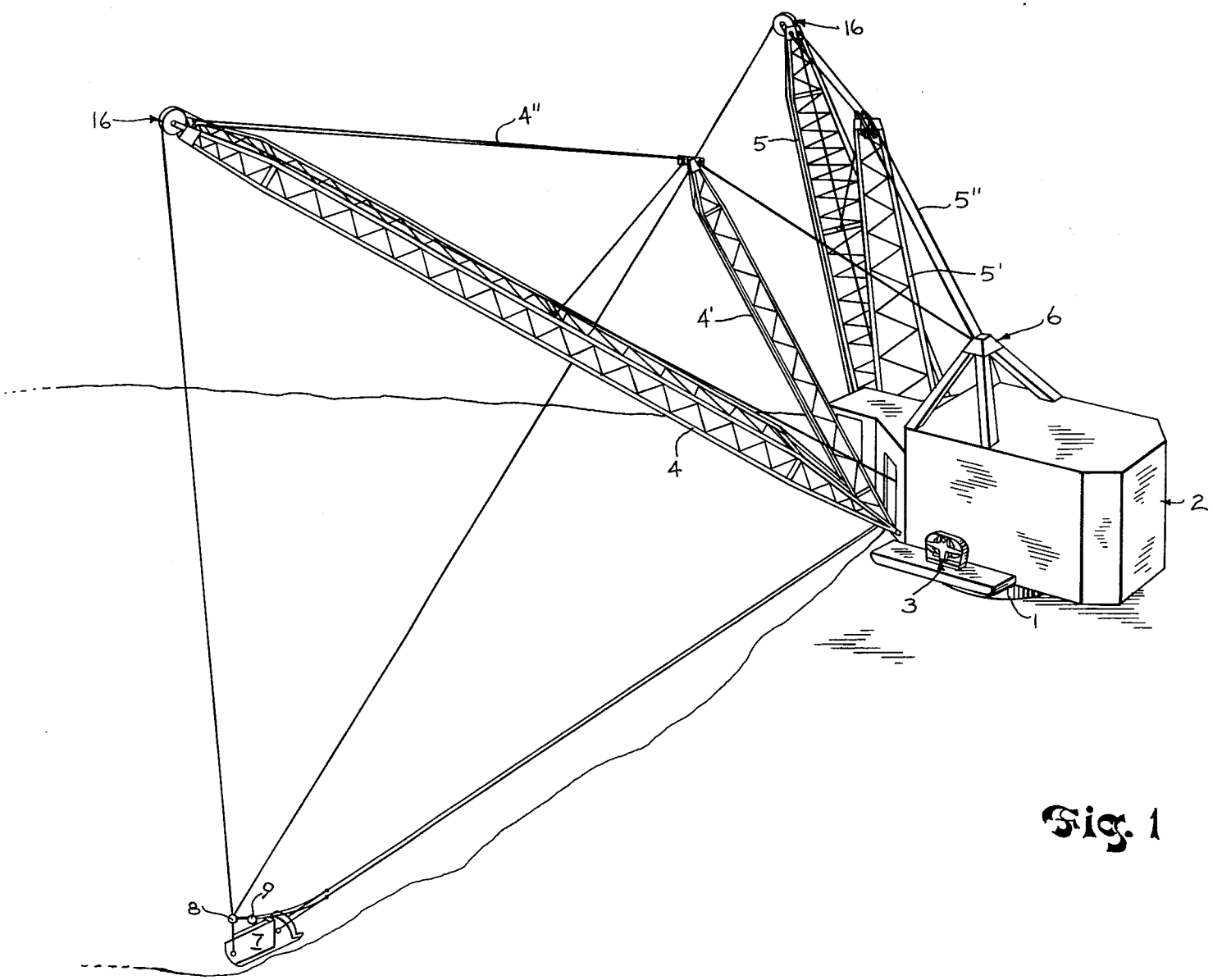
FIG. 1 is a somewhat schematic view in perspective showing a dragline constituting a preferred embodiment of the invention.

The excavator of FIG. 1 includes a tub 1 on which the machine rests during digging, and a machinery platform and housing 2 revolvably mounted on the tub 1 in conventional fashion. Mounted on the platform and housing 2 are a pair of walking shoe assemblies 3 that are on opposite sides of and approximately parallel to the longitudinal centerline of the platform 2 and that are actuated to walk the machine rearwardly or away from the front or boom end. The preferred embodiment incorporates a conventional Monighan cam type walking mechanism. However, systems such as those shown in Beitzel U.S. Pat. No. 3,265,145 issued Aug. 9, 1966, for "Walking Equipment For Dragline Excavators And The Like," or Kraschnewski U.S. Pat. No. 3,375,892 issued Apr. 2, 1968, for "Stepping-Type Propulsion Means For Excavators," may be used depending upon machine type and size; and any other suitable sort of known walking mechanism might be used.

Suitably footed on the front end of the platform 2 are two booms 4 and 5 which, in the preferred embodiment, are of identical lattice construction of any suitable type. The booms 4 and 5 are disposed at a 90° horizontal angle relative to one another, and are conventionally supported by means of associated masts 4' and 5' and stays 4'' and 5''. The inner ends of the stays are connected to an A-frame assembly 6 supported on the platform 2; in the preferred embodiment this is a four legged assembly as shown, but any suitable arrangement might be substituted. While the booms 4 and 5 are shown disposed at a 90° angle, other angles might be selected, and in some cases it may be desirable to construct the machine so that the relative position of the booms can be changed to suit given conditions.

The machine is provided with a bucket 7 of any suitable design, and there is a conventional rigging arrangement for the bucket 7 including a hoist hitch 8 and a dump block 9. Other than the double hoisting arrangement to be described, the bucket 7 operates in normal fashion.

Figure 2:
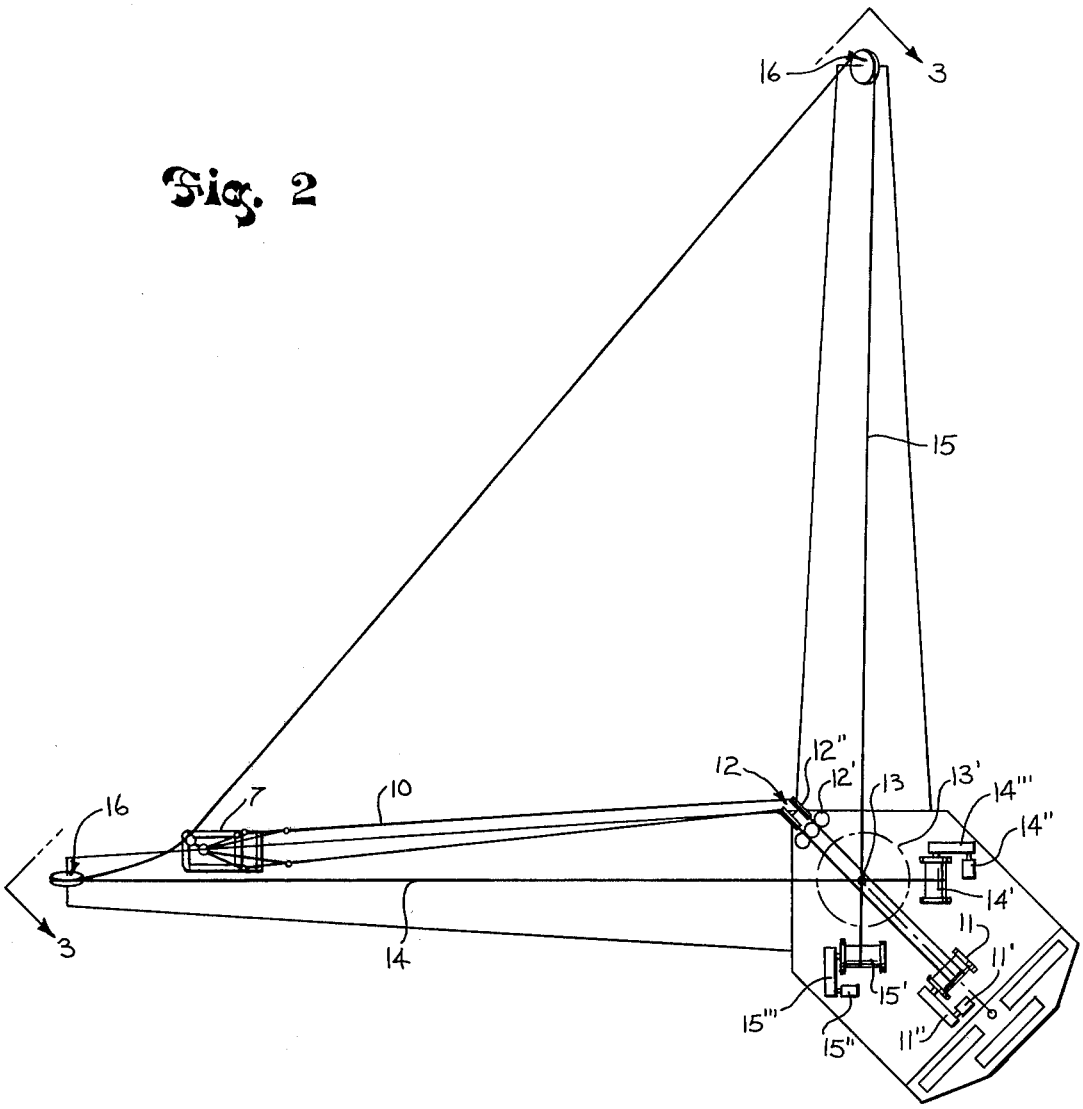
FIG. 2 is a schematic top plan view, with a number of parts removed or shown schematically for the sake of clarity, of the dragline of FIG. 1.

Referring to FIG. 2, a drag mechanism includes dragrope 10 leading from a drag hoist drum 11, preferably driven by a conventional variable speed electrical motor 11' having a gear speed reducer 11'', on the platform 2. The dragrope 10 then passes through a fairlead assembly 12 at the front end of the platform 2 to the bucket 7. A variable speed electric motor is used to obtain high capacity for the excavator. However, a conventional hydraulic motor may also be used in suitable size ranges. In the preferred embodiment, the dragrope 10 is double, but a single rope might be used and the rope 10 can be considered as single for purposes of description. The fairlead assembly 12 may be of any suitable construction, but as will become apparent it must be capable of accommodating substantial lateral angular deflection of the rope 10. In the preferred embodiment, the fairlead assembly 12 includes four horizontal sheaves 12', only three of which can be seen in FIG. 2. There are two vertically spaced center sheaves 12' on a common vertical axis and opposite side sheaves 12' each at the same level as a respective center sheave, and each component of the rope 10 passes through one of the respective sets of sheaves thus formed. There are also two sets of two vertical sheaves 12'' disposed forwardly of the sheaves 12' with the horizontal axis of the members of each set being vertically and forwardly offset, and each component of the rope 10 then passes through one set of sheaves 12''. This arrangement is well known and no further description is needed, but it should be noted that it is desirable to make the horizontal sheaves 12' larger than usual to accommodate the added lateral deflection of the rope 10 involved in the operation of the invention. In FIG. 2, reference numeral 13 indicates the center of rotation of the platform 2, and 13' indicates the circumference of the circular bearing for the platform 2 on the tub 1. Point 13, the drag hoist drum 11 and fairlead assembly 12 are all on and define the longitudinal centerline of the platform 2, and the dragrope 10 is essentially on the same line.

As can be seen in FIG. 2, the booms 4 and 5 are disposed symmetrically on opposite sides of and adjacent the fairlead assembly 12, and therefore the longitudinal center line of the machine, each being at a horizontal angle of about 45° to the centerline. A hoist mechanism for the boom 4 includes a hoist line 14 that leads from a hoist drum 14' mounted on the platform 2 and powered by a variable speed electric motor 14'' having a gear speed reducer 14'''. A corresponding mechanism for boom 5 includes a hoist line 15 that leads from another hoist drum 15' on the platform 2 and powered by another variable speed electric motor 15'' having a gear speed reducer 15'''. The motors 14'' and 15'' may be of any suitable type, including hydraulic within suitable size ranges, but should operate at relatively variable speeds. The hoist lines 14 and 15 extend around identical boom point sheave assemblies 16 on the ends of the booms 4 and 5, and both are connected to the hoist hitch 8. The hoist drums 14' and 15' and their respective boom point sheave assemblies 16 are in alignment with the center of rotation 13.

The control arrangement for the hoist drums 14' and 15' is shown schematically in FIG. 4. There is preferably a single "joystick" type of control handle 17 movable along one line to control hoisting or lowering and along a perpendicular line to control the relative speed of the two drums 14' and 15'. Electric control is preferred, but hydraulic controls may be used. Specific arrangements and circuitry for controls of this type, electrical or hydraulic, are well known to those skilled in the art and any suitable arrangement, or an equivalent arrangement using more than one operating handle, can obviously be substituted. Any suitable known arrangement can be used for operating and controlling the drag hoist drum 11.

As shown in the drawings, the boom 4 is serving as a digging boom and boom 5 serves as a dumping boom; since they are identical in the preferred embodiment, either can serve either function. Each cycle of operation begins when the bucket 7 spotted in a start position 18 substantially directly under the point of the digging boom 4. From this position the dragrope 10 is used in conventional fashion to pull the bucket 7 toward the front of the machine to a filled position indicated by the reference numeral 19, and during this movement the hoist lines 14 and 15 are both kept in a minimum slack condition. The control lever 17 is then actuated to hoist the bucket 7, but the operator will cause the hoist line 15 to be reeled in at a greater rate of speed, as the result of which the bucket 7 will move to a dump position 20 under the point of the dumping boom 5. Tension is maintained on the dragrope 10 until the bucket 7 is under the boom 5, and is then released on that the bucket 7 will dump in usual fashion, the bucket being shown in a fully dumped position in FIG. 3. The operator will then initiate a lowering action, but will cause the line 15 to be payed out more rapidly, as the result of which the bucket 7 will return to its start position 18.

While working, the digging boom 4 is over the excavating area, while the dumping boom 5 is off to the side over the dumping area. The 90° angle between the booms 4 and 5 is ordinarily appropriate for this purpose, but as previously indicated this angle could be changed if desired. When the machine is to be walked toward the rear, the platform 2 is first revolved to a position where its longitudinal centerline is parallel to the position of the boom 4 as seen in FIG. 2 and the machine is then walked the desired distance, after which the frame 2 is again revolved back to the angular position seen in FIG. 2.

The crucial feature of the invention is that no swinging or revolving of the platform 2 is necessary during the digging cycle, the bucket 7 being moved between digging and dumping positions through the use of the hoist ropes 14 and 15. As previously indicated, this results in a very significant reduction of the time required for each cycle—up to about 25% under normal conditions. The economic implications of this drastic reduction of cycle time can easily be appreciated, and the resulting productivity increase can be expected to exceed by a very substantial amount the cost of providing an additional boom and hoist mechanism.

Figure 6:
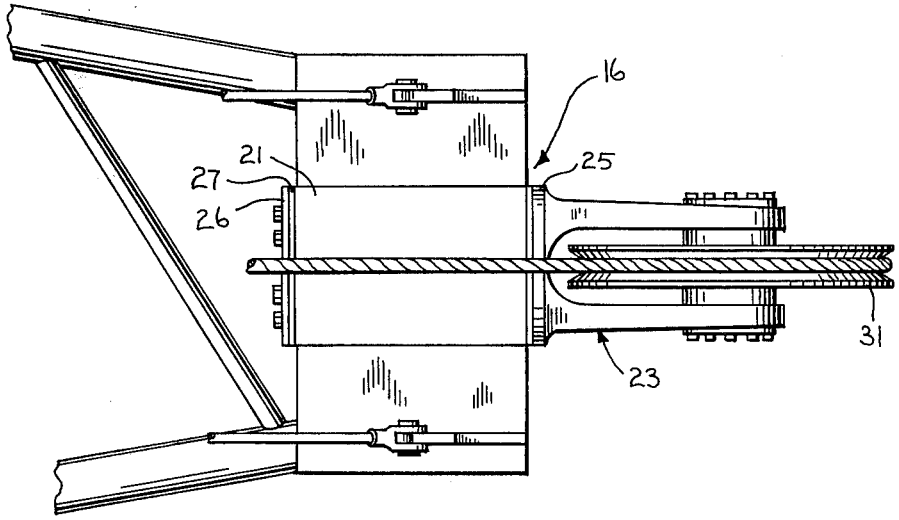
FIG. 6 is a view through the plane 6—6 shown in FIG. 5.

As noted above, the arrangement shown requires that the dragrope 10 move through a relatively great angular range, and the type of fairlead assembly shown in aforementioned U.S. Pat. No. 3,912,230 will accommodate this. In addition, however, the hoist ropes 14 and 15 will move through substantial angles, and most boom point sheave assemblies will not allow for this movement. Accordingly, the boom point sheave assemblies 16 have been specially constructed as illustrated in FIGS. 5 and 6. Each assembly 16 includes a base portion 21 fixed to the tip of the respective boom 4 or 5 and defining a cylindrical bore 22 generally in alignment with the longitudinal axis of the boom. A sheave mounting bracket 23 has an inner cylindrical shaft portion 24 that extends through and is freely rotatably received in the bore 22, the bracket 23 being held against axial movement by means of an integral collar 25 that bears against the base 21 at the outer end of the bore 22 and a retainer plate 26 that is removably bolted to the inner end of the shaft 24 after it has been inserted through the bore 22 and bears against the base 21 at the inner end thereof. Suitable thrust bearings 27 and journal bearings 28 are provided.

The bracket 23 also includes a bifurcated outer end 29 that mounts a transverse shaft 30 on which the boom point sheave 31 is freely rotatably mounted. The sheave 31 is freely rotatable about an axis that corresponds to the shaft portion 24 and essentially corresponds to the longitudinal axis of its boom 4 or 5. In the preferred embodiment, rotation through a full 360° would be possible, but the weight of the bucket 7 at the end of the ropes 14 and 15 and their engagement with the side flanges of the sheave 31 limits rotation. If desired, mechanical means could be provided to limit rotation within a desired range, but in any event rotation through at least a substantial arc should be allowed to accommodate the extreme positions of the ropes 14 and 15. It should be noted that the outer end 29 of the bracket 23 is angled downwardly relative to the shaft 24; this means that the sheave 31 will tend to hang in the vertical orientation shown in FIGS. 5 and 6.

While a preferred embodiment of the invention has been shown and described, various modifications are obviously possible without departure from the full scope and spirit of the invention. Various boom, fairlead, point sheave and control arrangements known to those skilled in the art might be substituted. It is not imperative that the booms 4 and 5 be identical if it is desired to use only one of them as a digging boom, but the arrangement shown is considered preferable because of its versatility. In view of the possible modifications, the invention is not intended to be limited by the showing or description herein, or in any other manner, except insofar as may specifically be required.

I claim:

1. In a dragline having a machinery platform, a bucket, and a drag mechanism on the platform including a dragrope leading directly from the platform to the bucket, the combination comprising: two booms footed on the frame and disposed at a horizontal angle to one another, one of the booms being a digging boom and the other a dumping boom; and hoist mechanisms for the booms, each hoist mechanism including a hoist rope leading over the top of the respective boom to the bucket, the drag mechanism being operable to move the bucket from a start position under the digging boom to a filled position under the digging boom and closer to the platform, the hoist mechanisms being operable at relatively different speeds to move the bucket from filled position to a dump position under the dumping boom and back to start position.

2. The combination of claim 1 wherein: either boom can serve as the digging boom with the other then serving as the dumping boom, the drag mechanism serving the same purpose in either case.

3. The combination of claim 2 wherein: the dragrope leads from a point essentially on the longitudinal centerline of the platform and the booms are footed on opposite sides of and at approximately equal horizontal angles to said centerline.

4. The combination of claim 3 wherein: each boom is at an angle of approximately forty-five degrees to the centerline.

* * * * *